US009751127B2

(12) United States Patent
Sugiura et al.

(10) Patent No.: US 9,751,127 B2
(45) Date of Patent: Sep. 5, 2017

(54) PULLING-UP-TYPE CONTINUOUS CASTING APPARATUS AND PULLING-UP-TYPE CONTINUOUS CASTING METHOD

(71) Applicant: TOYOTA JIDOSHA KABUSHIKI KAISHA, Toyota-shi (JP)

(72) Inventors: Naoaki Sugiura, Takahama (JP); Yusuke Yokota, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/037,925

(22) PCT Filed: Oct. 9, 2014

(86) PCT No.: PCT/JP2014/077626
§ 371 (c)(1),
(2) Date: May 19, 2016

(87) PCT Pub. No.: WO2015/079823
PCT Pub. Date: Jun. 4, 2015

(65) Prior Publication Data

US 2016/0288199 A1 Oct. 6, 2016

(30) Foreign Application Priority Data

Nov. 26, 2013 (JP) ..... 2013-244005

(51) Int. Cl.
*B22D 11/16* (2006.01)
*B22D 11/14* (2006.01)
(Continued)

(52) U.S. Cl.
CPC ..... *B22D 11/168* (2013.01); *B22D 11/041* (2013.01); *B22D 11/145* (2013.01);
(Continued)

(58) Field of Classification Search
CPC ..... B22D 11/145; B22D 11/20; B22D 11/188; B22D 11/041; B22D 11/168; B22D 11/14; B22D 11/141; B22D 46/00
See application file for complete search history.

(56) References Cited

U.S. PATENT DOCUMENTS 4,515,204 A 5/1985 Ohno
2013/0171021 A1 7/2013 Yaokawa et al.

FOREIGN PATENT DOCUMENTS

DE 197 38 466 C1 12/1998
FR 1.478.393 4/1967
(Continued)

OTHER PUBLICATIONS

P. Jorgensen, "Elaboration de monocristaux en feuilles geantes et traitements continus associes", ORBIT, vol. 5, No. 9, pp. 15-21, (Nov. 1, 1970), XP-001315303.
(Continued)

*Primary Examiner* — Kevin P Kerns
*Assistant Examiner* — Steven Ha
(74) *Attorney, Agent, or Firm* — Oblon, McClelland, Maier & Neustadt, L.L.P.

(57) ABSTRACT

A pulling-up-type continuous casting apparatus according to an aspect of the present invention includes a holding furnace that holds molten metal, and a shape defining member disposed above a molten-metal surface of the molten metal held in the holding furnace, the shape defining member being configured to define a cross-sectional shape of a cast-metal article to be cast as molten metal passes through an opening formed in the shape defining member. The opening is formed in such a manner that a size of the opening on a top surface of the shape defining member is larger than that on a bottom surface of the shape defining member. With this configuration, a cast-metal article having excellent sur-
(Continued)

face quality can be produced even when molten metal is drawn up in an oblique direction.

5 Claims, 14 Drawing Sheets

(51) Int. Cl.

| | |
|---|---|
| ***B22D 11/20*** | (2006.01) |
| ***B22D 46/00*** | (2006.01) |
| ***B22D 11/041*** | (2006.01) |
| ***B22D 11/18*** | (2006.01) |

(52) U.S. Cl.
CPC ..... *B22D 11/188* (2013.01); *B22D 11/20* (2013.01); *B22D 46/00* (2013.01)

(56) References Cited

FOREIGN PATENT DOCUMENTS

| | | | |
|---|---|---|---|
| JP | 58-157552 | A | 9/1983 |
| JP | 59-130649 | A | 7/1984 |
| JP | 63-30149 | A | 2/1988 |
| JP | 63-199050 | A | 8/1988 |
| JP | 2-205232 | A | 8/1990 |
| JP | 2012-61518 | A | 3/2012 |
| JP | 2013-193098 | A | 9/2013 |

OTHER PUBLICATIONS

International Search Report dated Jan. 30, 2015 in PCT/JP14/077626 Filed Oct. 9, 2014.

OBLIQUELY
PULLED-UP PART

PULLING-UP-TYPE CONTINUOUS CASTING APPARATUS AND PULLING-UP-TYPE CONTINUOUS CASTING METHOD

TECHNICAL FIELD

The present invention relates to a pulling-up-type continuous casting apparatus and a pulling-up-type continuous casting method.

BACKGROUND ART

Patent Literature 1 proposes a free casting method as a revolutionary pulling-up-type continuous casting method that does not requires any mold. As shown in Patent Literature 1, after a starter is submerged under the surface of a melted metal (molten metal) (i.e., molten-metal surface), the starter is pulled up, so that some of the molten metal follows the starter and is drawn up by the starter by the surface film of the molten metal and/or the surface tension. Note that it is possible to continuously cast a cast-metal article having a desired cross-sectional shape by drawing the molten metal and cooling the drawn molten metal through a shape defining member disposed in the vicinity of the molten-metal surface.

In the ordinary continuous casting method, the shape in the longitudinal direction as well as the shape in cross section is defined by the mold. In the continuous casting method, in particular, since the solidified metal (i.e., cast-metal article) needs to pass through the inside of the mold, the cast-metal article has such a shape that it extends in a straight-line shape in the longitudinal direction.

In contrast to this, the shape defining member used in the free casting method defines only the cross-sectional shape of the cast-metal article, while it does not define the shape in the longitudinal direction. As a result, cast-metal articles having various shapes in the longitudinal direction can be produced by pulling up the starter while moving the starter (or the shape defining member) in a horizontal direction. For example, Patent Literature 1 discloses a hollow cast-metal article (i.e., a pipe) having a zigzag shape or a helical shape in the longitudinal direction rather than the straight-line shape.

CITATION LIST

Patent Literature

PTL 1: Japanese Unexamined Patent Application Publication No. 2012-61518

SUMMARY OF INVENTION

Technical Problem

The present inventors have found the following problem.

In the free casting method disclosed in Patent Literature 1, as described above, the molten metal can be drawn up in an oblique direction rather than in the vertical direction by pulling up the starter while moving the starter (or the shape defining member) in a horizontal direction. It should be noted that if the pulling-up speed is constant, the thickness of the cast metal formed by drawing up the molten metal in an oblique direction is geometrically thinner than that of the cast metal formed by drawing up the molten metal in the vertical direction. Therefore, to make these thicknesses equal to each other, the pulling-up speed is reduced and the solidification interface is thereby lowered when the molten metal is drawn up in an oblique direction. However, if the shape defining member interferes with the solidification interface due to the lowered solidification interface, a solidified piece is formed, thus causing a problem that the surface quality of the cast-metal article deteriorates. That is, there is a problem that a cast-metal article formed by drawing up molten metal in an oblique direction tends to have a deteriorated surface quality.

The present invention has been made in view of the above-described problem, and an object thereof is to provide a pulling-up-type continuous casting apparatus and a pulling-up-type continuous casting method capable of producing a cast-metal article having an excellent surface quality even when molten metal is drawn up in an oblique direction.

Solution to Problem

A pulling-up-type continuous casting apparatus according to an aspect of the present invention includes:

a holding furnace that holds molten metal; and a shape defining member disposed above a molten-metal surface of the molten metal held in the holding furnace, the shape defining member being configured to define a cross-sectional shape of a cast-metal article to be cast as the molten metal passes through an opening formed in the shape defining member, in which the opening is formed in such a manner that a size of the opening on a top surface of the shape defining member is larger than that on a bottom surface of the shape defining member.

In the pulling-up-type continuous casting apparatus according to this aspect of the present invention, the opening in the shape defining member is formed in such a manner that the size of the opening on the top surface of the shape defining member is larger than that on the bottom surface of the shape defining member. As a result, an end face of the opening does not interfere with the solidification interface even when the molten metal is drawn up in an oblique direction and the solidification interface is thereby lowered. Consequently, the produced cast-metal article has an excellent surface quality.

A pulling-up-type continuous casting method according to an aspect of the present invention includes:

disposing a shape defining member above a molten-metal surface of molten metal held in a holding furnace, the shape defining member being configured to define a cross-sectional shape of a cast-metal article to be cast; and pulling up the molten metal while making the molten metal pass through an opening formed in the shape defining member, in which the opening is formed in such a manner that a size of the opening on a top surface of the shape defining member is larger than that on a bottom surface of the shape defining member.

In the pulling-up-type continuous casting method according to this aspect of the present invention, the opening in the shape defining member is formed in such a manner that the size of the opening on the top surface of the shape defining member is larger than that on the bottom surface of the shape defining member. As a result, an end face of the opening does not interfere with the solidification interface even when the molten metal is drawn up in an oblique direction and the solidification interface is thereby lowered. Consequently, the produced cast-metal article has an excellent surface quality.

A pulling-up-type continuous casting method according to another aspect of the present invention includes:

disposing a shape defining member above a molten-metal surface of molten metal held in a holding furnace, the shape defining member being configured to define a cross-sectional shape of a cast-metal article to be cast; and pulling up the molten metal while making the molten metal pass through the shape defining member, in which when the molten metal is pulled up in an oblique direction, a degree of submergence of the shape defining member under the molten-metal surface is increased compared to when the molten metal is pulled up in a vertical direction.

In the pulling-up-type continuous casting method according to this aspect of the present invention, when the molten metal is pulled up in an oblique direction, the degree of submergence of the shape defining member under the molten-metal surface is increased compared to when the molten metal is pulled up in the vertical direction. As a result, an end face of the opening in the shape-defining member does not interfere with the solidification interface even when the molten metal is drawn up in an oblique direction and the solidification interface is thereby lowered. Consequently, the produced cast-metal article has an excellent surface quality.

Advantageous Effects of Invention

According to the present invention, it is possible to provide a pulling-up-type continuous casting apparatus and a pulling-up-type continuous casting method capable of producing a cast-metal article having an excellent surface quality even when molten metal is drawn up in an oblique direction.

DESCRIPTION OF EMBODIMENTS

Specific exemplary embodiments to which the present invention is applied are explained hereinafter in detail with reference to the drawings. However, the present invention is not limited to exemplary embodiments shown below. Further, the following descriptions and the drawings are simplified as appropriate for clarifying the explanation.

First Exemplary Embodiment

Figure 1:
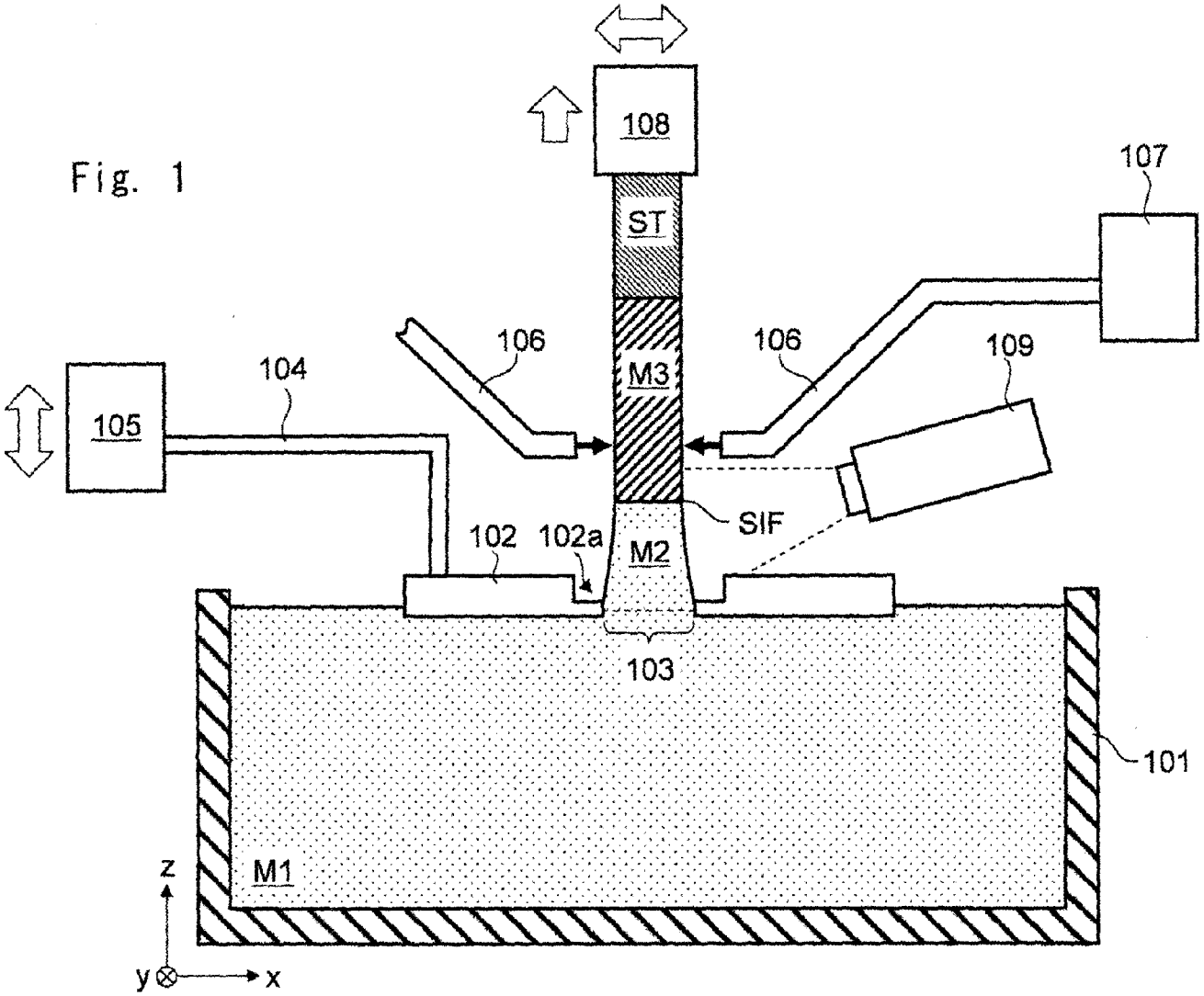
FIG. 1 is a schematic cross section of a free casting apparatus according to a first exemplary embodiment.

Firstly, a free casting apparatus (pulling-up-type continuous casting apparatus) according to a first exemplary embodiment is explained with reference to FIG. 1. FIG. 1 is a schematic cross section of a free casting apparatus according to the first exemplary embodiment. As shown in FIG. 1, the free casting apparatus according to the first exemplary embodiment includes a molten-metal holding furnace 101, a shape defining member 102, a support rod 104, an actuator 105, a cooling gas nozzle 106, a cooling gas supply unit 107, a pulling-up machine 108, and an image pickup unit (camera) 109.

Note that needless to say, the right-hand xyz-coordinate system shown in FIG. 1 is illustrated for the sake of convenience, in particular, for explaining the positional relation among components. In FIG. 1, the xy-plane forms a horizontal plane and the z-axis direction is the vertical direction. More specifically, the positive direction on the z-axis is the vertically upward direction.

The molten-metal holding furnace 101 contains molten metal M1 such as aluminum or its alloy, and maintains the molten metal M1 at a predetermined temperature at which the molten metal M1 has fluidity. In the example shown in FIG. 1, since the molten-metal holding furnace 101 is not replenished with molten metal during the casting process, the surface of molten metal M1 (i.e., molten-metal surface) is lowered as the casting process advances. Alternatively, the molten-metal holding furnace 101 may be replenished with molten metal as required during the casting process so that the molten-metal surface is kept at a fixed level. Note that the position of the solidification interface SIF can be raised by increasing the setting temperature of the molten-metal holding furnace 101 and the solidification interface SIF can be lowered by lowering the setting temperature of the molten-metal holding furnace 101. Needless to say, the molten metal M1 may be a metal other than aluminum and an alloy thereof.

The shape defining member 102 is made of ceramic or stainless, for example, and disposed above the molten metal M1. The shape defining member 102 defines the cross-sectional shape of cast metal M3 to be cast. The cast metal M3 shown in FIG. 1 is a plate or a solid cast-metal article having a rectangular shape in a horizontal cross section (hereinafter referred to as "lateral cross section"). Note that needless to say, there are no particular restrictions on the cross-sectional shape of the cast metal M3. The cast metal M3 may be a hollow cast-metal article such as a circular pipe and a rectangular pipe.

In the example shown in FIG. 1, the shape defining member 102 is disposed so that its bottom-side main surface (bottom surface) is in contact with the molten-metal surface. Therefore, it is possible to prevent oxide films formed on the surface of the molten metal M1 and foreign substances floating on the surface of the molten metal M1 from entering the cast metal M3.

Figure 2:
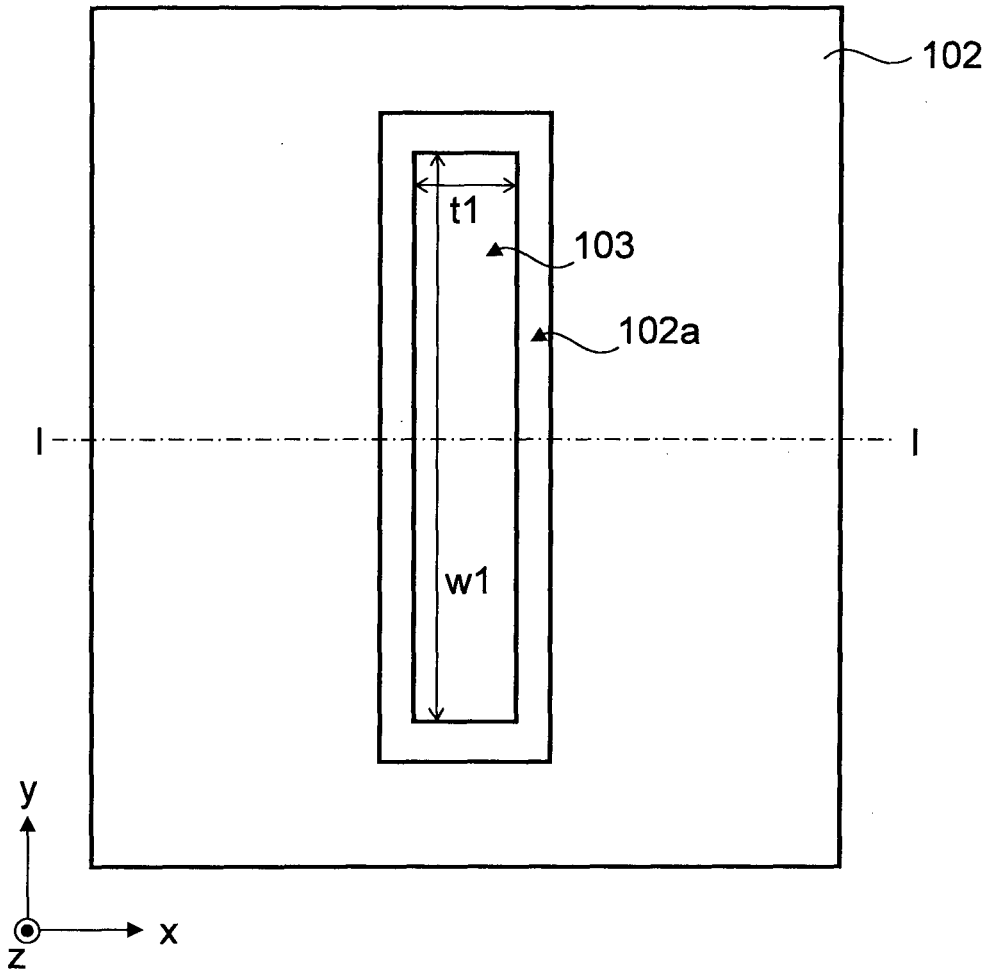
FIG. 2 is a plane view of a shape defining member 102 according to the first exemplary embodiment.

FIG. 2 is a plane view of the shape defining member 102 according to the first exemplary embodiment. Note that the cross section of the shape defining member 102 shown in FIG. 1 corresponds to a cross section taken along the line I-I in FIG. 2. As shown in FIG. 2, the shape defining member 102 has, for example, a rectangular shape as viewed from the top, and has a rectangular opening (molten-metal passage section 103) having a thickness t1 and a width w1 at the center thereof. Further, the xyz-coordinate system shown in FIG. 2 corresponds to that shown in FIG. 1.

It should be noted that the molten-metal passage section 103, which is an opening, is formed in such a manner that its size on the top surface of the shape defining member 102 is larger than that on the bottom surface of the shape defining member 102. As a result, the end face of the molten-metal passage section 103 does not interfere with the solidification interface SIF even when the solidification interface SIF is lowered so that the molten metal can be drawn up in an oblique direction. Consequently, the deterioration of the surface quality of the cast metal M3 can be prevented. As shown in FIGS. 1 and 2, in the shape defining member 102 according to the first exemplary embodiment, a cut-out 102*a* is formed on its top surface on the periphery of the molten-metal passage section 103. Note that the only requirement for this cut-out 102*a* is that the cut-out 102*a* should be at least on the side on which the drawn-up direction is inclined. That is, the cut-out 102*a* does not necessarily have to be formed on the entire circumference of the molten-metal passage section 103. Its detailed mechanism and advantageous effects are described later.

As shown in FIG. 1, the molten metal M1 follows the cast metal M3 and is pulled up by the cast metal M3 by its surface film and/or the surface tension. Further, the molten metal M1 passes through the molten-metal passage section 103 of the shape defining member 102. That is, as the molten metal M1 passes through the molten-metal passage section 103 of the shape defining member 102, an external force(s) is applied from the shape defining member 102 to the molten metal M1 and the cross-sectional shape of the cast metal M3 is thereby defined. Note that the molten metal that follows the cast metal M3 and is pulled up from the molten-metal surface by the surface film of the molten metal and/or the surface tension is called "held molten metal M2". Further, the boundary between the cast metal M3 and the held molten metal M2 is the solidification interface SIF.

The support rod 104 supports the shape defining member 102. The support rod 104 is connected to the actuator 105. By the actuator 105, the shape defining member 102 can be moved in the up/down direction (vertical direction, i.e., z-axis direction) through the support rod 104. With this configuration, for example, it is possible to move the shape defining member 102 downward as the molten-metal surface is lowered due to the advance of the casting process.

The cooling gas nozzle (cooling section) 106 is cooling means for spraying a cooling gas (for example, air, nitrogen, or argon) supplied from the cooling gas supply unit 107 on the cast metal M3 and thereby cooling the cast metal M3. The position of the solidification interface SIF can be lowered by increasing the flow rate of the cooling gas and the position of the solidification interface SIF can be raised by reducing the flow rate of the cooling gas. Note that the cooling gas nozzle 106 can also be moved in the up/down direction (vertical direction, i.e., z-axis direction) and the horizontal direction (x-axis direction and/or y-axis direction). Therefore, for example, it is possible to move the cooling gas nozzle 106 downward in conformity with the movement of the shape defining member 102 as the molten-metal surface is lowered due to the advance of the casting process. Alternatively, the cooling gas nozzle 106 can be moved in a horizontal direction in conformity with the horizontal movement of the pulling-up machine 108.

By cooling the cast metal M3 by the cooling gas while pulling up the cast metal M3 by using the pulling-up machine 108 connected to the starter ST, the held molten metal M2 located in the vicinity of the solidification interface SIF is successively solidified from its upper side (the positive side in the z-axis direction) toward its lower side (the negative side in the z-axis direction) and the cast metal M3 is formed. The position of the solidification interface SIF can be raised by increasing the pulling-up speed of the pulling-up machine 108 and the position of the solidification interface SIF can be lowered by reducing the pulling-up speed. Further, the held molten metal M2 can be drawn up in an oblique direction by pulling up the molten-metal with the starter ST while moving the pulling-up machine 108 in a horizontal direction (x-axis direction and/or y-axis direction). Therefore, it is possible to arbitrarily change the shape in the longitudinal direction of the cast metal M3. Note that the shape in the longitudinal direction of the cast metal M3 may be arbitrarily changed by moving the shape defining member 102 in a horizontal direction instead of moving the pulling-up machine 108 in a horizontal direction.

The image pickup unit 109 continuously monitors an area(s) near the solidification interface SIF, which is the boundary between the cast metal M3 and the held molten metal M2. As described in detail later, it is possible to determine the solidification interface SIF from an image(s) taken by the image pickup unit 109.

Figure 3:
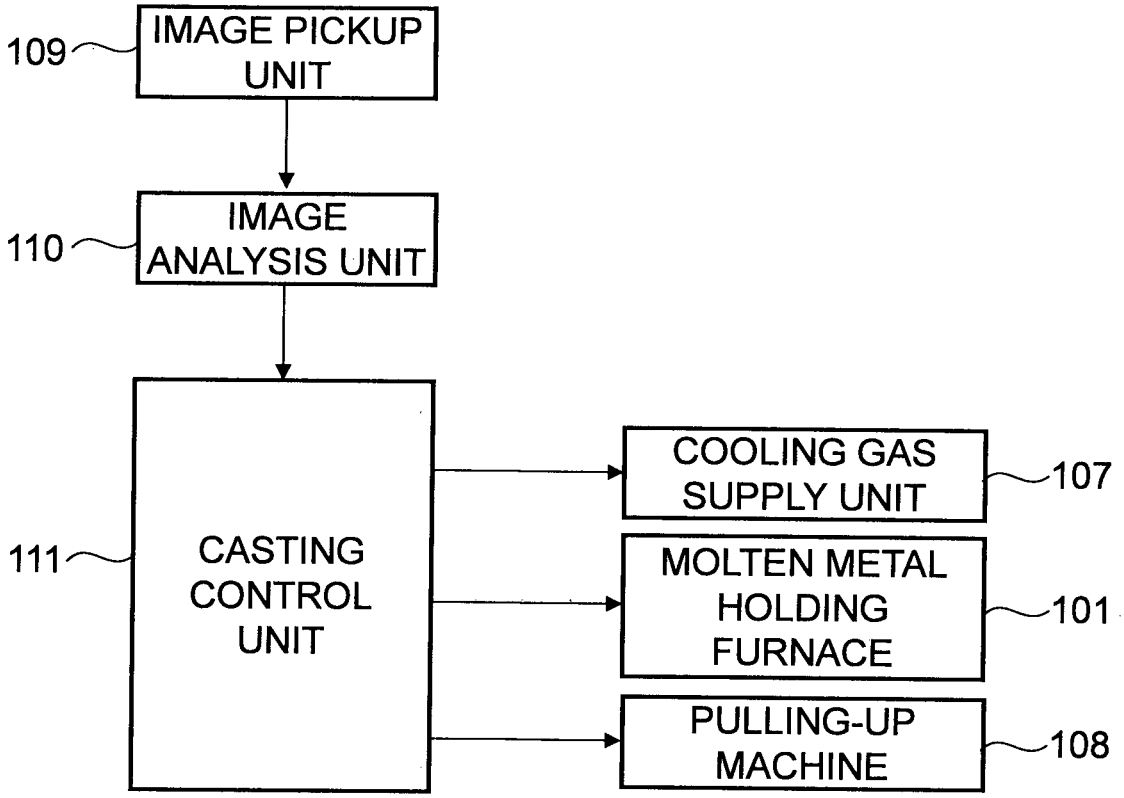
FIG. 3 is a block diagram of a casting control system provided in a free casting apparatus according to the first exemplary embodiment.

Next, a casting control system provided in a free casting apparatus according to the first exemplary embodiment is explained with reference to FIG. 3. FIG. 3 is a block diagram of the casting control system provided in the free casting apparatus according to the first exemplary embodiment. This casting control system is provided to keep the position (height) of the solidification interface SIF within a predetermined reference range.

As shown in FIG. 3, this casting control system includes an image pickup unit 109, an image analysis unit 110, a casting control unit 111, a pulling-up machine 108, a molten-metal holding furnace 101, and a cooling gas supply unit 107. Note that the image pickup unit 109, the pulling-up machine 108, the molten-metal holding furnace 101, and the cooling gas supply unit 107 have already been explained with reference to FIG. 1, and therefore their detailed explanations are omitted here.

The image analysis unit 110 detects fluctuations on the surface of the held molten metal M2 from an image(s) taken by the image pickup unit 109. Specifically, the image analysis unit 110 can detect fluctuations on the surface of the held molten metal M2 by comparing a plurality of successively-taken images with one another. In contrast to this, no fluctuation occurs on the surface of the cast metal M3. Therefore, it is possible to determine the solidification interface based on the presence/absence of fluctuations.

Figure 4:
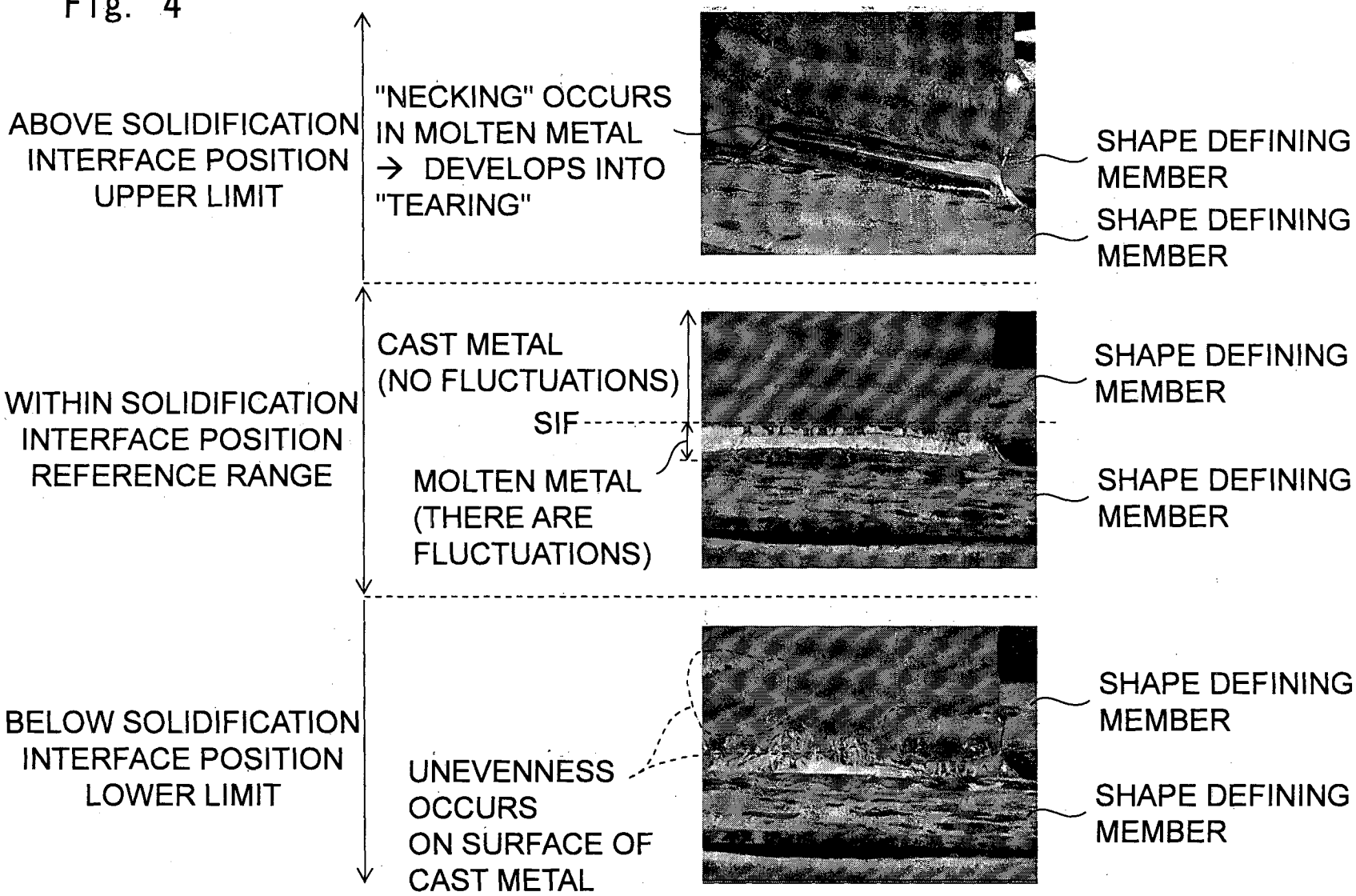
FIG. 4 shows three example images near a solidification interface.

A more detailed explanation of the above is given hereinafter with reference to FIG. 4. FIG. 4 shows three example images near the solidification interface. FIG. 4 shows, from the top to bottom thereof, an image example of a case where the position of the solidification interface rises above the upper limit therefor, an image example of a case where the position of the solidification interface is within the reference range, and an image example of a case where the position of the solidification interface falls below the lower limit therefor. As shown in the middle image example in FIG. 4, for example, the image analysis unit 110 determines the boundary between an area in which fluctuations are detected (i.e., the molten metal) and an area in which no fluctuation is detected (i.e., cast metal) as the solidification interface in an image(s) taken by the image pickup unit 109.

The casting control unit 111 includes a storage unit (not shown) that memorizes a reference range (upper and lower limits) for the solidification interface position. Then, when the solidification interface determined by the image analysis unit 110 is higher than the upper limit, the casting control unit 111 reduces the pulling-up speed of the pulling-up machine 108, lowers the setting temperature of the molten-metal holding furnace 101, or increases the flow rate of the cooling gas supplied from the cooling gas supply unit 107. On the other hand, when the solidification interface determined by the image analysis unit 110 is lower than the lower limit, the casting control unit 111 increases the pulling-up speed of the pulling-up machine 108, raises the setting temperature of the molten-metal holding furnace 101, or reduces the flow rate of the cooling gas supplied from the cooling gas supply unit 107. In the control of these three conditions, two or more conditions may be changed at the same time. However, it is preferable that only one condition is changed because it makes the control easier. Further, a priority order may be determined for these three conditions in advance, and the conditions may be changed in the descending order of the priority.

The upper and lower limits for the solidification interface position are explained with reference to FIG. 4. As shown in the top image example in FIG. 4, when the solidification interface position rises above the upper limit therefor, "necking" occurs in the held molten metal M2 and it develops into "tearing". The upper limit for the solidification interface position can be determined in advance by examining whether "necking" occurs in the held molten metal M2 or not while changing the height of the solidification interface.

On the other hand, when the solidification interface position is below the lower limit therefor, "unevenness" occurs on the surface of the cast metal M3 as shown in the bottom image example in FIG. 4, thus causing a defective shape of the cast metal M3. The lower limit for the solidification interface position can be determined in advance by examining whether "unevenness" occurs on the surface of the cast metal M3 or not while changing the height of the solidification interface. Note that it is considered that this unevenness is caused by solidified pieces that are formed within the shape defining member 102 due to the excessively low solidification interface position.

Figure 5:
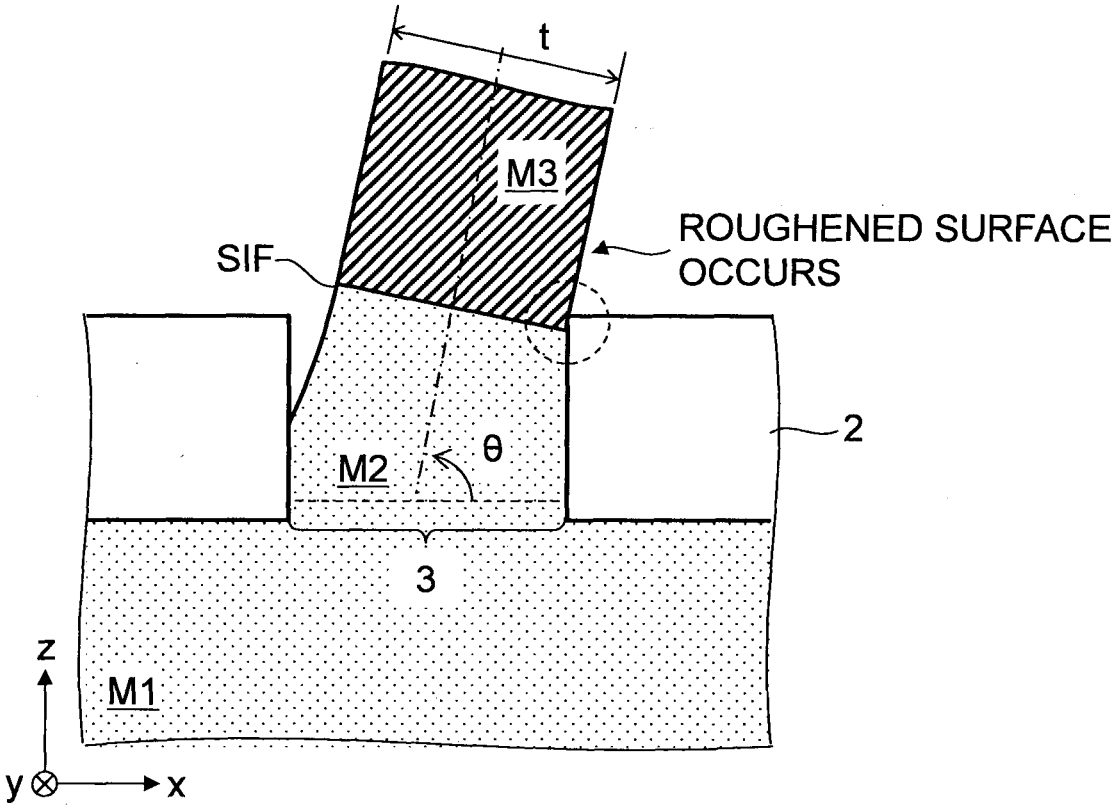
FIG. 5 is an enlarged cross section schematically showing a shape defining member 2 according to a comparative example.
Figure 6:
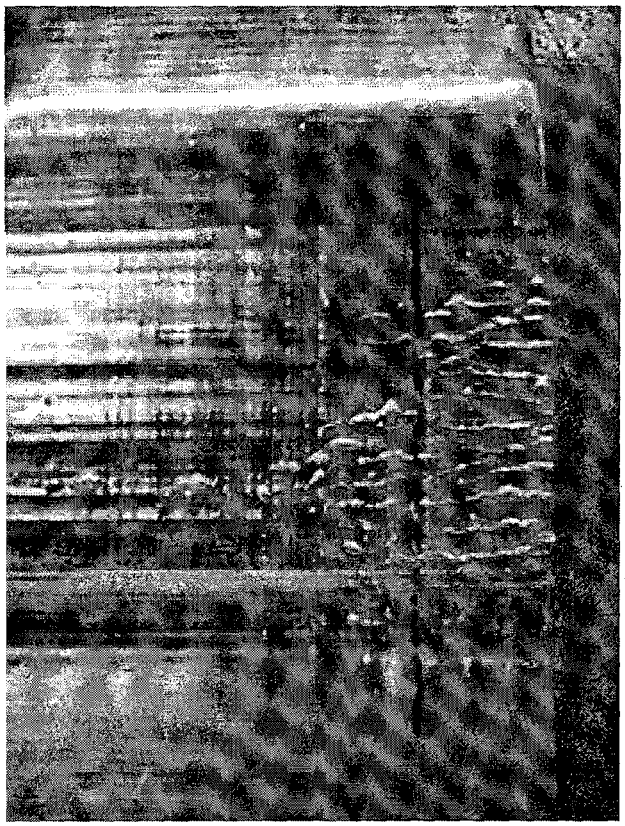
FIG. 6 is a macro-photograph of a cast-metal article formed by pulling up it in an oblique direction by using the shape defining member 2 according to the comparative example.
Figure 7:
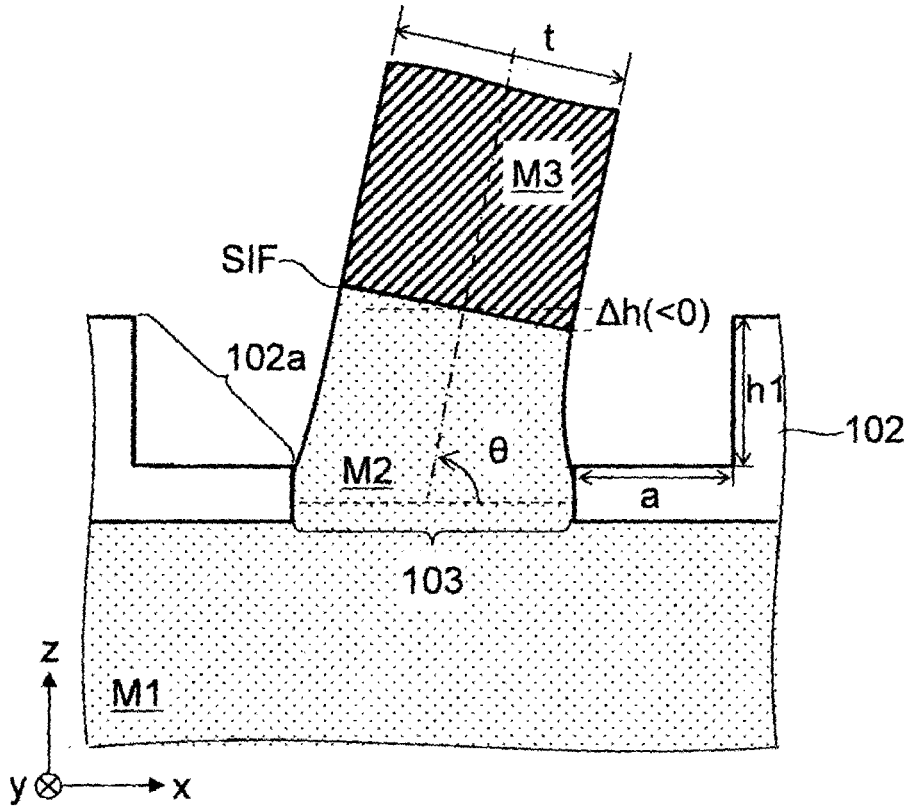
FIG. 7 is an enlarged cross section schematically showing a shape defining member 102 according to the first exemplary embodiment.
Figure 8:
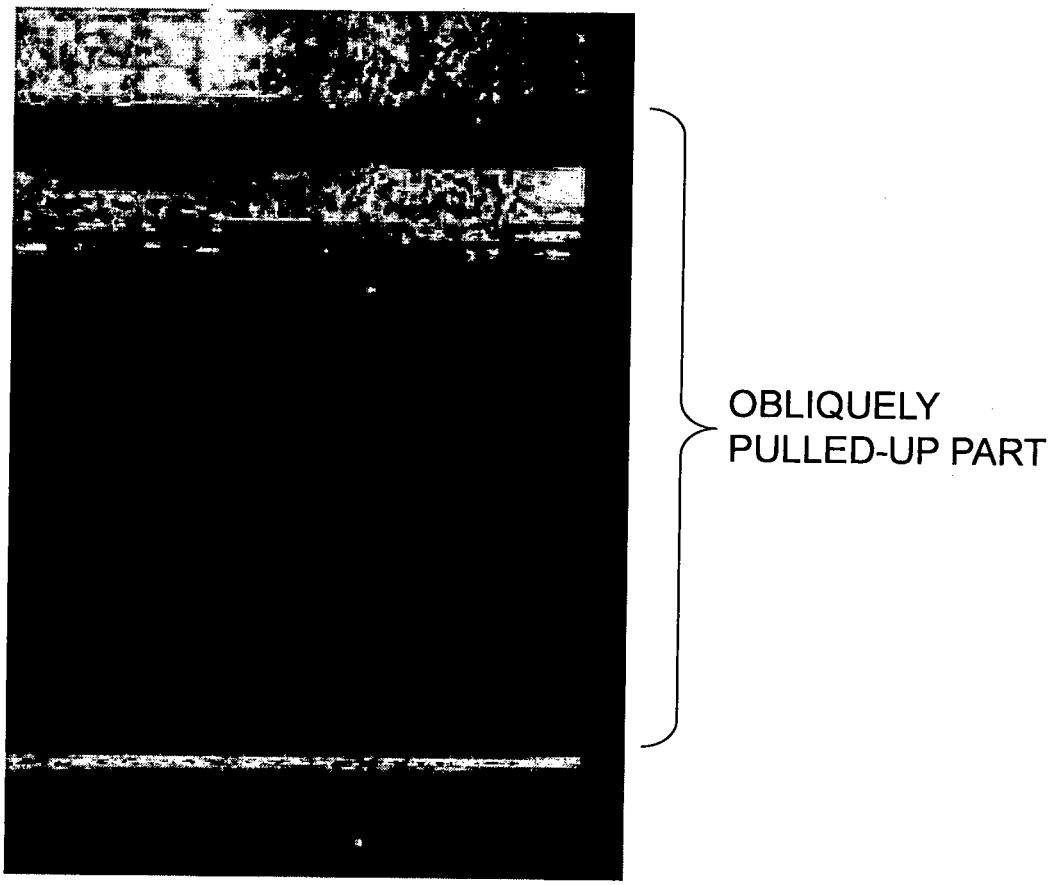
FIG. 8 is a macro-photograph of a cast-metal article formed by pulling up it in an oblique direction by using the shape defining member 102 according to the first exemplary embodiment.

The mechanism and advantageous effects of this exemplary embodiment are explained in detail with reference to FIGS. 5 to 8. FIG. 5 is an enlarged cross section schematically showing a shape defining member 2 according to a comparative example. FIG. 6 is a macro-photograph of a cast-metal article formed by pulling it up in an oblique direction by using the shape defining member 2 according to the comparative example. FIG. 7 is an enlarged cross section schematically showing a shape defining member 102 according to the first exemplary embodiment. FIG. 8 is a macro-photograph of a cast-metal article formed by pulling it up in an oblique direction by using the shape defining member 102 according to the first exemplary embodiment. Note that the xyz-coordinate systems shown in FIGS. 5 and 7 also correspond to that shown in FIG. 1.

As shown in FIG. 5, no cut-out is formed in the molten-metal passage section 3 of the shape defining member 2 according to the comparative example. Therefore, the end face of the molten-metal passage section 3 interferes with the solidification interface SIF when the molten metal is drawn up in an oblique direction and the solidification interface SIF is thereby lowered as indicated by the broken-line circle in FIG. 5. It is considered that, as a result, the surface of the cast metal M3 is roughened and thus the surface quality deteriorates. As shown in the "obliquely pulled-up part" in FIG. 6, when the molten metal was pulled up in an oblique direction by using the shape defining member 2 according to the comparative example, a roughened surfaced was observed in the cast-metal article.

In contrast to this, a cut-out 102*a* is formed on the top side of the molten-metal passage section 103 of the shape defining member 102 according to the first exemplary embodiment as shown in FIG. 7. That is, the molten-metal passage section 103, which is an opening, is formed in such a manner that its size on the top surface of the shape defining member 102 is larger than that on the bottom surface of the shape defining member 102. As a result, as shown in FIG. 7, the end face of the molten-metal passage section 103 does not interfere with the solidification interface SIF even when the molten metal is drawn up in an oblique direction and the solidification interface SIF is thereby lowered in order to make the thickness t of the cast metal M3 uniform. Therefore, the surface of the cast metal M3 is not roughened and the deterioration of the surface quality is prevented. As shown in the "obliquely pulled-up part" in FIG. 8, when the molten metal was pulled up in an oblique direction by using the shape defining member 102 according to the first exemplary embodiment, no roughened surfaced was observed in the cast-metal article.

Next, a method for determining the height h1 and the width a of the cut-out 102*a* is explained with reference to FIG. 7. As shown in FIG. 7, assume that the angle between the molten-metal surface and the pulling-up direction is a pulling-up angle $\theta$ ($0° < \theta < 90°$ as shown in FIG. 7. Further, the difference between the height at the center of the solidification interface SIF and the height of the lowest point of the solidification interface SIF is represented by $\Delta h$ (>0). As shown in FIG. 7, this difference $\Delta h$ can be geometrically calculated. That is, by using the thickness t of the cast metal M3, the difference $\Delta h$ can be expressed as "$\Delta h = t/2 \times \sin(90-\theta)$". Note that, assuming that the height at the center of the solidification interface SIF is equal to the height of the solidification interface SIF when the cast metal M3 is pulled up in the vertical direction, the amount by which the solidification interface SIF is lowered when the cast metal M3 is pulled up in an oblique direction is exactly the same as the above-described difference "$\Delta h = t/2 \times \sin(90-\theta)$".

Therefore, the height h1 of the cut-out 102*a* is preferably set so that the expression "$h1 > \Delta h = t/2 \times \sin(90-\theta min)$" holds, where $\theta min$ is the minimum pulling-up angle when the cast metal M3 is pulled up in the most inclined state. The solidification interface SIF in the state where the cast metal M3 is pulled up in the vertical direction can be determined experimentally by using the casting control system according to the first exemplary embodiment (in particular, by using the image pickup unit 109 and the image analysis unit 110). Further, based on the geometrical relation, the width a of the cut-out 102*a* is preferably set so that the expression "$a > h1/\tan(\theta min)$" holds. By doing so, it is possible to prevent the interference between the solidification interface SIF and the molten-metal passage section 103 more effectively.

Figure 9:
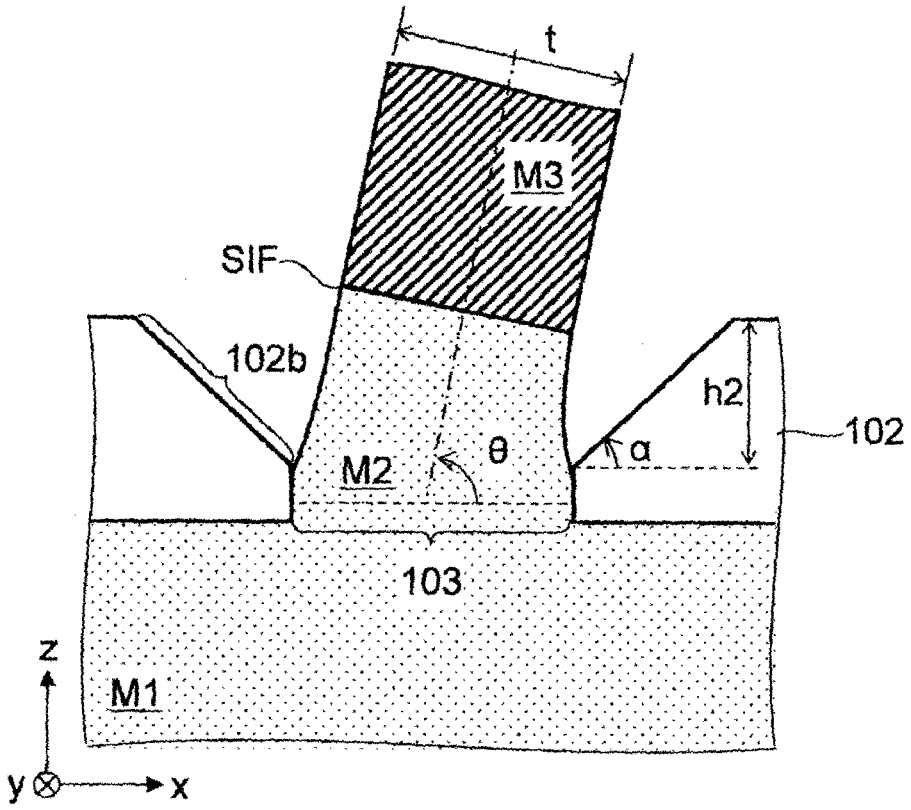
FIG. 9 is an enlarged cross section schematically showing a shape defining member 102 according to a modified example of the first exemplary embodiment.

FIG. 9 is an enlarged cross section schematically showing a shape defining member 102 according to a modified example of the first exemplary embodiment. In the shape defining member 102 according to the modified example of the first exemplary embodiment, an inclined part 102*b* is formed in place of the cut-out 102*a* shown in FIG. 7 (FIG. 1). As a result, the end face of the molten-metal passage section 103 does not interfere with the solidification interface SIF even when the solidification interface SIF is lowered so that the molten metal can be drawn up in an oblique direction. Consequently, the surface of the cast metal M3 is not roughened and the deterioration of the surface quality is prevented. Note that the inclined part 102*b* does not necessarily have to have the flat surface. That is, the inclined part 102*b* may have a concave surface.

Similarly to the height h1 of the cut-out 102*a*, the height h2 of the inclined part 102*b* is preferably set so that the expression "$h2>\Delta h=t/2\times\sin(90-\theta min)$" holds. Further, the inclination $\alpha$ of the inclined part 102*b* is preferably set so as to be smaller than the minimum pulling-up angle $\theta$min. By doing so, it is possible to prevent the interference between the solidification interface SIF and the molten-metal passage section 103 more effectively.

In the free casting apparatus according to the first exemplary embodiment, the molten-metal passage section (opening) 103 is formed in the shape defining member 102 in such a manner that its size on the top surface of the shape defining member 102 is larger than that on the bottom surface of the shape defining member 102. As a result, the end face of the molten-metal passage section 103 does not interfere with the solidification interface SIF even when the molten metal is drawn up in an oblique direction and the solidification interface SIF is thereby lowered in order to make the thickness t of the cast metal M3 uniform. Consequently, the deterioration of the surface quality of the cast metal M3 can be prevented. Further, the free casting apparatus includes an image pickup unit that takes an image(s) of an area near the solidification interface, an image analysis unit that detects fluctuations on the molten-metal surface from the image(s) and determines the solidification interface, and a casting control unit that changes the casting condition when the solidification interface is not within the reference range. Therefore, the free casting apparatus can perform feedback control in order to keep the solidification interface within the predetermined reference range, and thereby improve the size accuracy and the surface quality of the cast-metal article. Further, it is possible to obtain information about the positions of the solidification interface at specific casting speeds and use such information when the cut-out 102*a* (FIG. 7) or the inclined part 102*b* (FIG. 9) of the shape defining member 102 are designed (i.e., when the molten-metal passage section 103 is designed).

Next, a free casting method according to the first exemplary embodiment is explained with reference to FIG. 1.

Firstly, the starter ST is lowered by the pulling-up machine 108 and made to pass through the molten-metal passage section 103 of the shape defining member 102, and the tip of the starter ST is submerged into the molten metal M1.

Next, the starter ST starts to be pulled up at a predetermined speed. Note that even when the starter ST is pulled away from the molten-metal surface, the molten metal M1 follows the starter ST and is pulled up from the molten-metal surface by the surface film and/or the surface tension. That is, the held molten metal M2 is formed. As shown in FIG. 1, the held molten metal M2 is formed in the molten-metal passage section 103 of the shape defining member 102. That is, the held molten metal M2 is shaped into a given shape by the shape defining member 102.

Next, since the starter ST or the cast metal M3 is cooled by a cooling gas, the held molten metal M2 is indirectly cooled and successively solidifies from its upper side toward its lower side. As a result, the cast metal M3 grows. In this manner, it is possible to continuously cast the cast metal M3.

Figure 10:
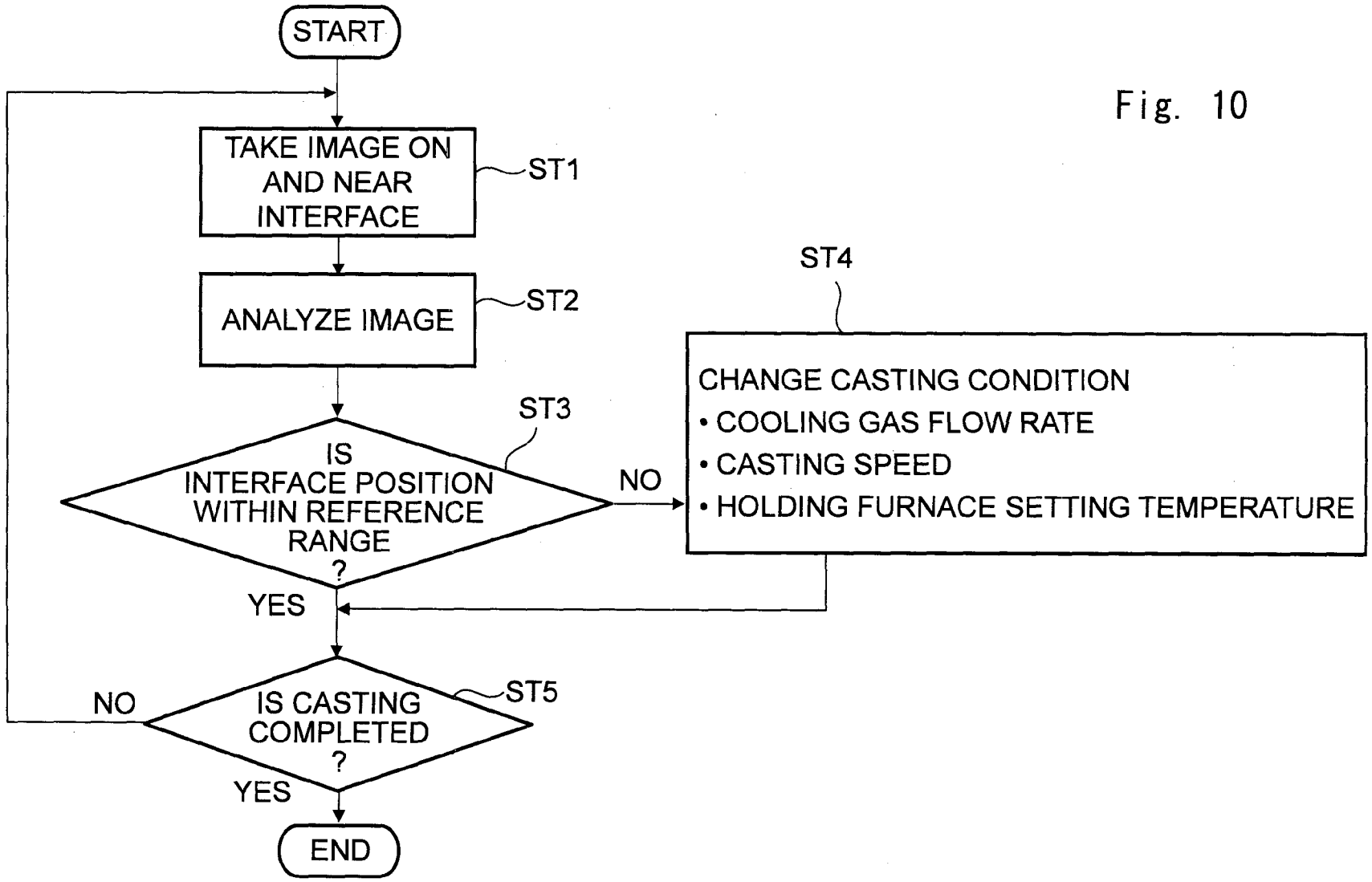
FIG. 10 is a flowchart for explaining a casting control method according to the first exemplary embodiment.

In the free casting method according to the first exemplary embodiment, the free casting apparatus is controlled so that the solidification interface is kept within a predetermined reference range. A casting control method is explained hereinafter with reference to FIG. 10. FIG. 10 is a flowchart for explaining a casting control method according to the first exemplary embodiment.

Firstly, an image(s) of an area(s) near the solidification interface is taken by the image pickup unit 109 (step ST1).

Next, the image analysis unit 110 analyzes the image(s) taken by the image pickup unit 109 (step ST2). Specifically, fluctuations on the surface of the held molten metal M2 are detected by comparing a plurality of successively-taken images with one another. Then, the image analysis unit 110 determines the boundary between an area in which fluctuations are detected and an area in which no fluctuation is detected as the solidification interface in the images taken by the image pickup unit 109.

Next, the casting control unit 111 determines whether or not the position of the solidification interface determined by the image analysis unit 110 is within a reference range (step ST3). When the solidification interface position is not within the reference range (No at step ST3), the casting control unit 111 changes one of the cooling gas flow rate, the casting speed, and the holding furnace setting temperature (step ST4). After that, the casting control unit 111 determines whether the casting is completed or not (step ST5).

Specifically, in the step ST4, when the solidification interface determined by the image analysis unit 110 is higher than the upper limit, the casting control unit 111 reduces the pulling-up speed of the pulling-up machine 108, lowers the setting temperature of the molten-metal holding furnace 101, or increases the flow rate of the cooling gas supplied from the cooling gas supply unit 107. On the other hand, when the solidification interface determined by the image analysis unit 110 is lower than the lower limit, the casting control unit 111 increases the pulling-up speed of the pulling-up machine 108, raises the setting temperature of the molten-metal holding furnace 101, or reduces the flow rate of the cooling gas supplied from the cooling gas supply unit 107.

When the solidification interface position is within the reference range (Yes at step ST3), the solidification interface control proceeds to the step ST5 without changing the casting condition.

When the casting has not been completed yet (No at step ST5), the solidification interface control returns to the step ST1. On the other hand, when the casting has been already completed (Yes at step ST5), the solidification interface control is finished.

Second Exemplary Embodiment

Figure 11:
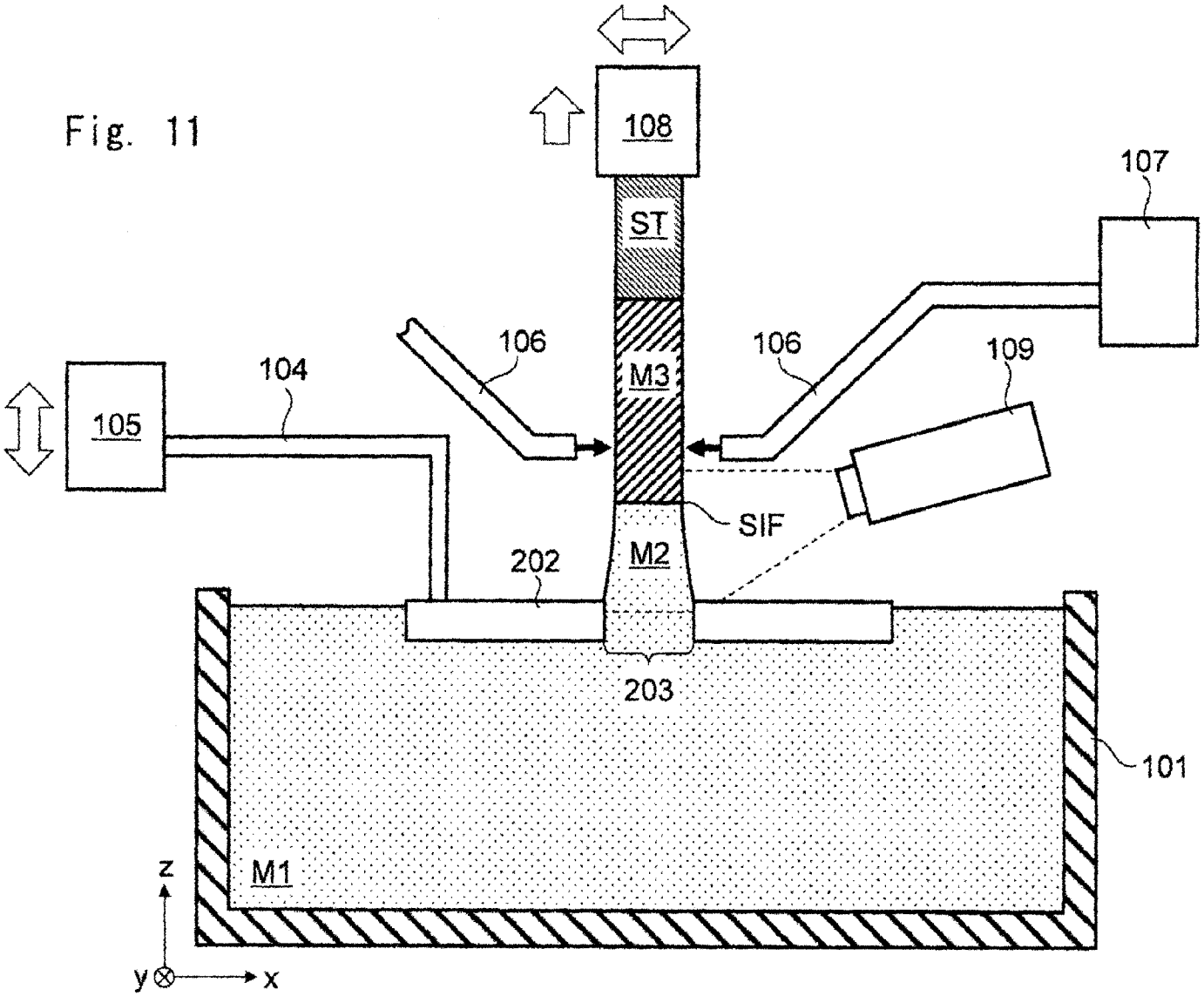
FIG. 11 is a schematic cross section of a free casting apparatus according to a second exemplary embodiment.

Next, a free casting apparatus according to a second exemplary embodiment is explained with reference to FIG. 11. FIG. 11 is a schematic cross section of a free casting apparatus according to the second exemplary embodiment.

Neither the cut-out 102*a* (see FIG. 7) nor the inclined part 102*b* (see FIG. 9) according to the first exemplary embodiment is formed in the shape defining member 202 according to the second exemplary embodiment. That is, the shape defining member 202 according to the second exemplary embodiment has a shape similar to that of the shape defining member 2 according to the comparative example shown in FIG. 5. However, in the free casting apparatus according to the second exemplary embodiment, the degree of submergence of the shape defining member 202 into the molten metal M1 is increased when the molten metal is drawn up in an oblique direction. FIG. 11 shows a state where the degree of submergence of the shape defining member 202 into the molten metal M1 is increased. As a result, the end face of the molten-metal passage section 103 does not interfere with the solidification interface SIF even when the molten metal is drawn up in an oblique direction and the solidification interface SIF is thereby lowered in order to make the thickness t of the cast metal M3 uniform. Consequently, the deterioration of the surface quality of the cast metal M3 can be prevented.

Figure 12:
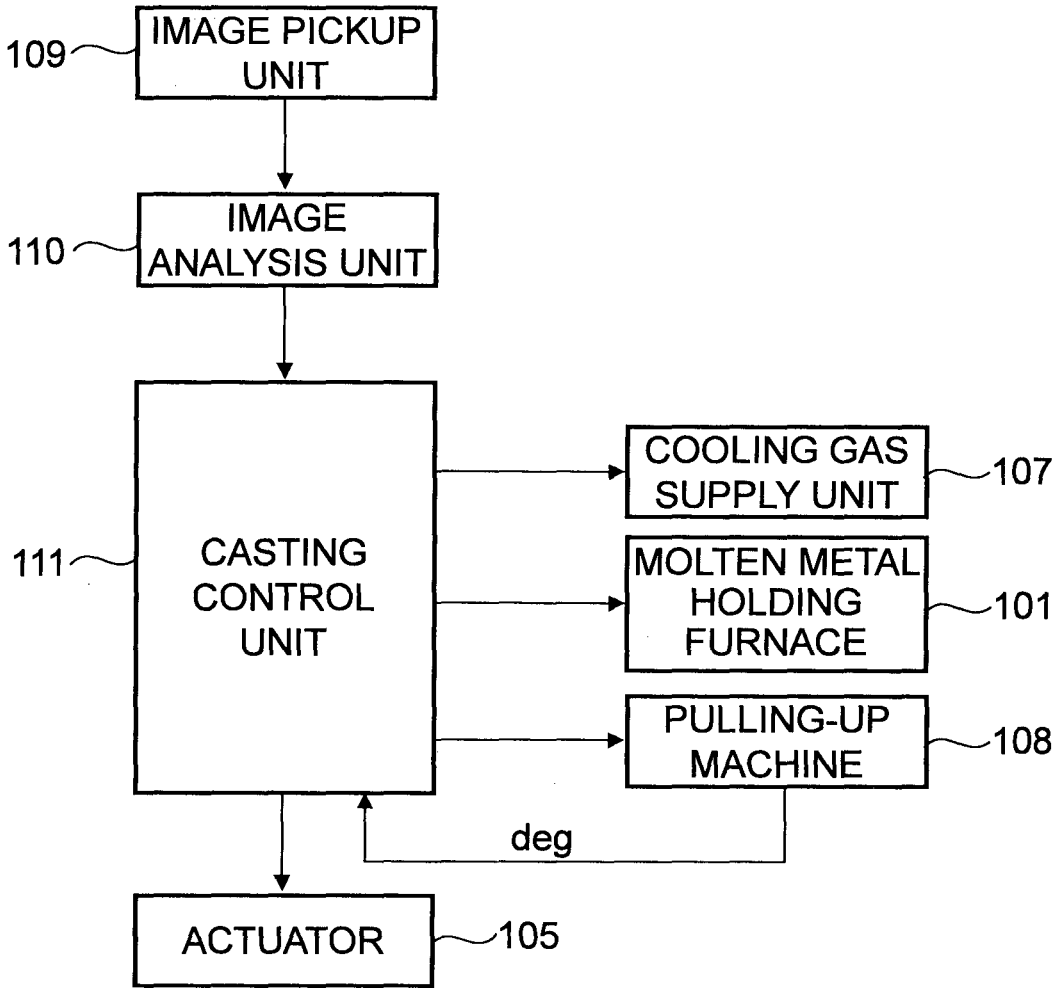
FIG. 12 is a block diagram of a casting control system provided in a free casting apparatus according to the second exemplary embodiment.

Next, a casting control system provided in a free casting apparatus according to the second exemplary embodiment is explained with reference to FIG. 12. FIG. 12 is a block diagram of the casting control system provided in the free casting apparatus according to the second exemplary embodiment. This casting control system keeps the position (height) of the solidification interface SIF within a predetermined reference range and moves the shape defining member 202 vertically according to the pulling-up angle θ.

As shown in FIG. 12, the casting control system according to the second exemplary embodiment vertically moves the shape defining member 202 by controlling the actuator 105 according to pulling-up angle information deg (which corresponds to the pulling-up angle θ) that the casting control unit 111 obtains from the pulling-up machine 108. Specifically, the state where the cast metal is pulled up with the starter in the vertical direction (pulling-up angle θ=) 90° is defined as a reference state. Then, the degree of submergence of the shape defining member 202 under the molten-metal surface of the molten metal M1 is increased as the pulling-up angle θ is decreased. That is, the degree of submergence is increased compared to that in the state where the pulling-up angle θ is 90°. The increment of the degree of submergence can be determined in a similar fashion to that of the determination of the height h1 of the cut-out 102*a* explained in the first exemplary embodiment. That is, the increment of the degree of submergence may be determined based on, for example, the above-described expression for the difference "$\Delta h = t/2 \times \sin(90-\theta)$". The rest of configuration is similar to that of the first exemplary embodiment, and therefore its explanation is omitted.

Modified Example of Second Exemplary Embodiment

Figure 13:
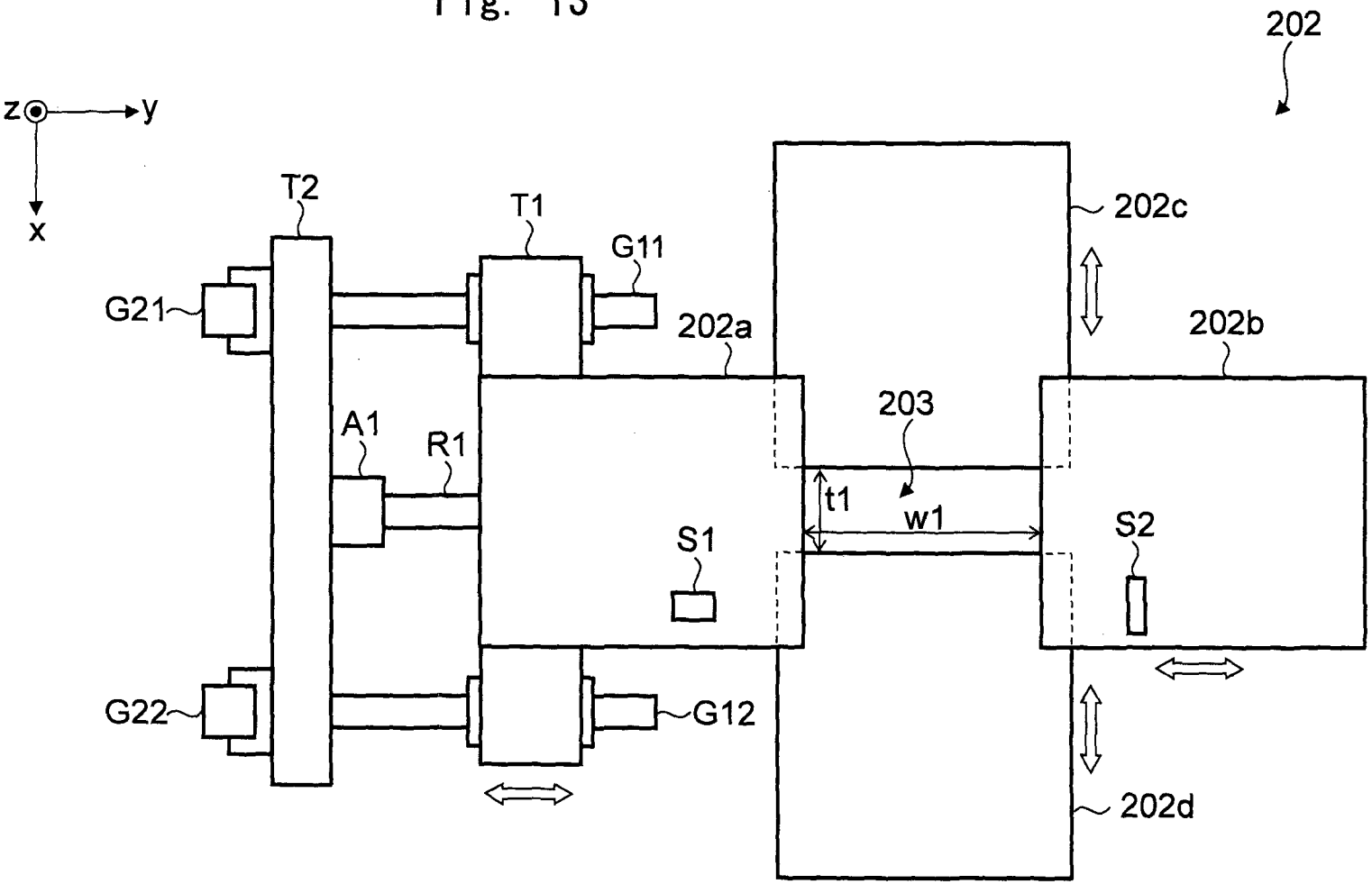
FIG. 13 is a plane view of a shape defining member 202 according to a modified example of the second exemplary embodiment.
Figure 14:
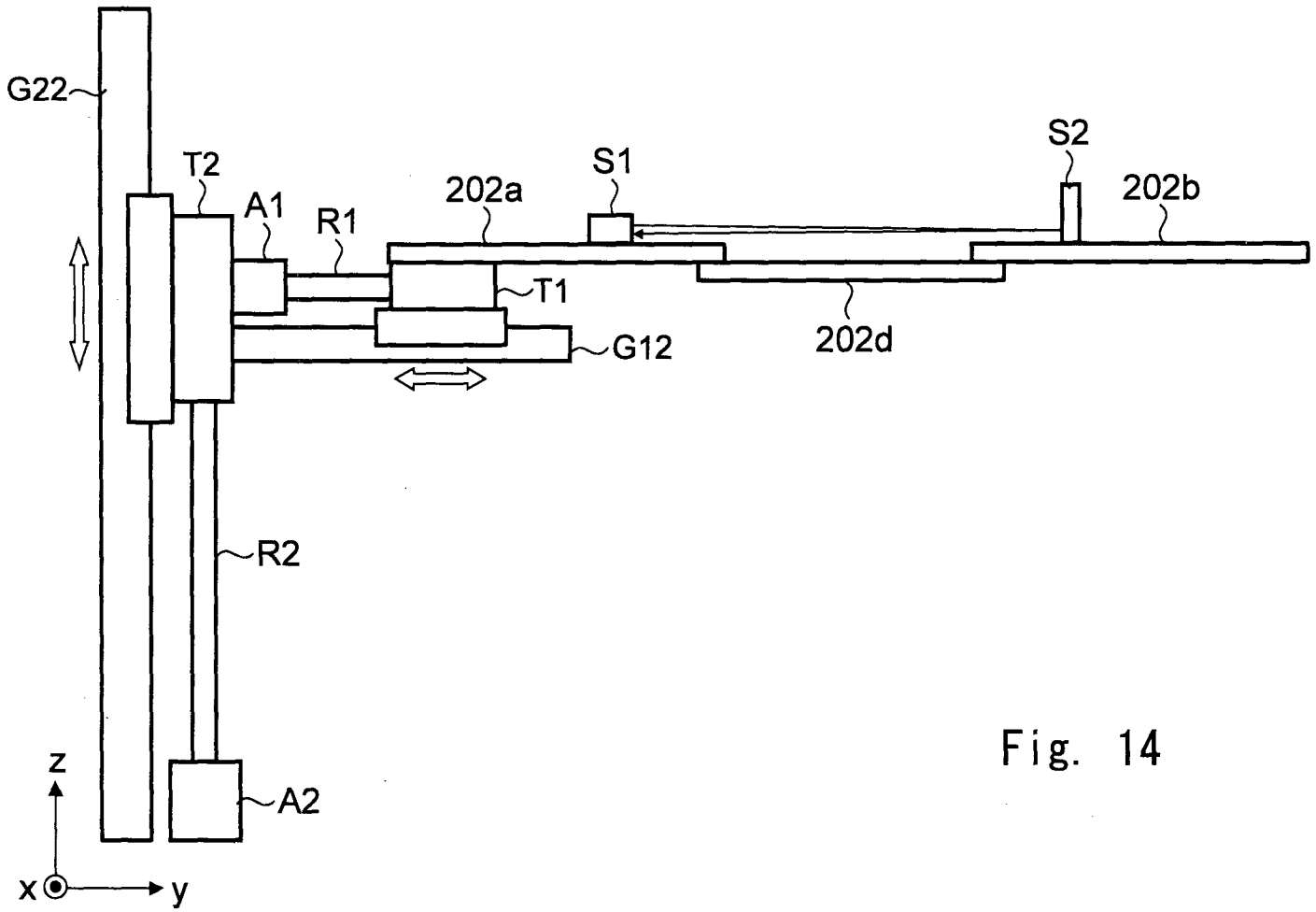
FIG. 14 is a side view of the shape defining member 202 according to the modified example of the second exemplary embodiment.

Next, a free casting apparatus according to a modified example of the second exemplary embodiment is explained with reference to FIGS. 13 and 14. FIG. 13 is a plane view of a shape defining member 202 according to a modified example of the second exemplary embodiment. FIG. 14 is a side view of the shape defining member 202 according to the modified example of the second exemplary embodiment. Note that the xyz-coordinate systems shown in FIGS. 13 and 14 also correspond to that shown in FIG. 1.

The shape defining member 202 according to the second exemplary embodiment shown in FIG. 11 is composed of one plate. Therefore, the thickness t1 and the width w1 of the molten-metal passage section 203 are fixed. In contrast to this, the shape defining member 202 according to the modified example of the second exemplary embodiment includes four rectangular shape defining plates 202*a*, 202*b*, 202*c* and 202*d* as shown in FIG. 13. That is, the shape defining member 202 according to the modified example of the second exemplary embodiment is divided into a plurality of sections. With this configuration, it is possible to change the thickness t1 and the width w1 of the molten-metal passage section 203. Further, the four rectangular shape defining plates 202*a*, 202*b*, 202*c* and 202*d* can be moved in unison in the z-axis direction.

As shown in FIG. 13, the shape defining plates 202*a* and 202*b* are arranged to be opposed to each other in the y-axis direction. Further, as shown in FIG. 14, the shape defining plates 202*a* and 202*b* are disposed at the same height in the z-axis direction. The gap between the shape defining plates 202*a* and 202*b* defines the width w1 of the molten-metal passage section 203. Further, since each of the shape defining plates 202*a* and 202*b* can be independently moved in the y-axis direction, the width w1 can be changed. Note that, as shown in FIGS. 13 and 14, a laser displacement gauge S1 and a laser reflector plate S2 may be provided on the shape defining plates 202*a* and 202*b*, respectively, in order to measure the width w1 of the molten-metal passage section 203.

Further, as shown in FIG. 13, the shape defining plates 202*c* and 202*d* are arranged to be opposed to each other in the x-axis direction. Further, the shape defining plates 202*c* and 202*d* are disposed at the same height in the z-axis direction. The gap between the shape defining plates 202*c* and 202*d* defines the thickness t1 of the molten-metal passage section 203. Further, since each of the shape defining plates 202*c* and 202*d* can be independently moved in the x-axis direction, the thickness t1 can be changed.

The shape defining plates 202*a* and 202*b* are disposed in such a manner that they are in contact with the top sides of the shape defining plates 202*c* and 202*d*.

Next, a driving mechanism for the shape defining plate 202*a* is explained with reference to FIGS. 13 and 14. As shown in FIGS. 13 and 14, the driving mechanism for the shape defining plate 202*a* includes slide tables T1 and T2, linear guides G11, G12, G21 and G22, actuators A1 and A2, and rods R1 and R2. Note that although each of the shape defining plates 202*b*, 202*c* and 202*d* also includes its driving mechanism as in the case of the shape defining plate 202*a*, the illustration of them is omitted in FIGS. 13 and 14.

As shown in FIGS. 13 and 14, the shape defining plate 202*a* is placed and fixed on the slide table T1, which can be slid in the y-axis direction. The slide table T1 is slidably placed on a pair of linear guides G11 and G12 extending in parallel with the y-axis direction. Further, the slide table T1 is connected to the rod R1 extending from the actuator A1 in the y-axis direction. With the above-described configuration, the shape defining plate 202*a* can be slid in the y-axis direction.

Further, as shown in FIGS. 13 and 14, the linear guides G11 and G12 and the actuator A1 are placed and fixed on the slide table T2, which can be slid in the z-axis direction. The slide table T2 is slidably placed on a pair of linear guides G21 and G22 extending in parallel with the z-axis direction. Further, the slide table T2 is connected to the rod R2 extending from the actuator A2 in the z-axis direction. The linear guides G21 and G22 and the actuator A2 are fixed on a horizontal floor surface or a horizontal pedestal (not shown). With the above-described configuration, the shape defining plate 202*a* can be slid in the z-axis direction. Note that examples of the actuators A1 and A2 include a hydraulic cylinder, an air cylinder, and a motor.

Note that the present invention is not limited to the above-described exemplary embodiments, and various modifications can be made without departing from the spirit and scope of the present invention.

For example, the modified example of the second exemplary embodiment can also be applied to the first exemplary embodiment.

This application is based upon and claims the benefit of priority from Japanese patent application No. 2013-244005, filed on Nov. 26, 2013, the disclosure of which is incorporated herein in its entirety by reference.

REFERENCE SIGNS LIST

101 MOLTEN METAL HOLDING FURNACE
102, 202 SHAPE DEFINING MEMBER
102*a* CUT-OUT
102*b* INCLINED PART
103, 203 MOLTEN-METAL PASSAGE SECTION
104 SUPPORT ROD
105 ACTUATOR
106 COOLING GAS NOZZLE
107 COOLING GAS SUPPLY UNIT
108 PULLING-UP MACHINE
109 IMAGE PICKUP UNIT
110 IMAGE ANALYSIS UNIT
111 CASTING CONTROL UNIT
202*a*-202*d* SHAPE DEFINING PLATE
A1, A2 ACTUATOR
G11, G12, G21, G22 LINEAR GUIDE
M1 MOLTEN METAL
M2 HELD MOLTEN METAL
M3 CAST METAL
R1, R2 ROD
S1 LASER DISPLACEMENT GAUGE
S2 LASER REFLECTOR PLATE
SIF SOLIDIFICATION INTERFACE
ST STARTER
T1, T2 SLIDE TABLE

The invention claimed is:

1. A pulling-up continuous casting apparatus comprising:
a holding furnace that holds molten metal;
a shape defining member disposed above a molten-metal surface of the molten metal held in the holding furnace, the shape defining member being configured to define a cross-sectional shape of a cast-metal article to be cast as the molten metal passes through an opening formed in the shape defining member;
an image pickup unit that takes an image of the molten metal that has passed through the shape defining member; and
an image analysis unit that detects a fluctuation on the molten metal from the image and determines a solidification interface based on presence/absence of the fluctuation, wherein
the opening is formed in such a manner that a size of the opening on a top surface of the shape defining member is larger than that on a bottom surface of the shape defining member, and
a shape of the opening is modified based on a position of the solidification interface determined by the image analysis unit and a pulling-up angle of the molten metal.

2. The pulling-up continuous casting apparatus according to claim 1, wherein a cut-out or an inclined part is formed on a periphery of the opening on the top surface of the shape defining member.

3. A pulling-up continuous casting method comprising:
disposing a shape defining member above a molten-metal surface of molten metal held in a holding furnace, the shape defining member being configured to define a cross-sectional shape of a cast-metal article to be cast;
pulling up the molten metal while making the molten metal pass through an opening formed in the shape defining member;
taking an image of the molten metal that has passed through the shape defining member; and
detecting a fluctuation on the molten metal from the image and determining a solidification interface based on presence/absence of the fluctuation, wherein
the opening is formed in such a manner that a size of the opening on a top surface of the shape defining member is larger than that on a bottom surface of the shape defining member, and
a shape of the opening is modified based on a position of the solidification interface determined based on the presence/absence of the fluctuation and a pulling-up angle of the molten metal.

4. The pulling-up continuous casting method according to claim 3, wherein a cut-out or an inclined part is formed on a periphery of the opening on the top surface of the shape defining member.

5. A pulling-up continuous casting method comprising:
disposing a shape defining member above a molten-metal surface of molten metal held in a holding furnace, the shape defining member being configured to define a cross-sectional shape of a cast-metal article to be cast;
pulling up the molten metal while making the molten metal pass through the shape defining member;
taking an image of the molten metal that has passed through the shape defining member; and
detecting a fluctuation on the molten metal from the image and determining a solidification interface based on presence/absence of the fluctuation, wherein
when the molten metal is pulled up in an oblique direction, a degree of submergence of the shape defining member under the molten-metal surface is increased compared to when the molten metal is pulled up in a vertical direction, and
the degree of submergence is determined based on a position of the determined solidification interface and a pulling-up angle of the molten metal.

* * * * *